United States Patent [19]

Mendelsohn et al.

[11] Patent Number: 4,497,391

[45] Date of Patent: Feb. 5, 1985

[54] MODULAR OPERATIONAL ELEVATOR CONTROL SYSTEM

[75] Inventors: Arnold Mendelsohn, Simsbury; Joe K. Koe, Avon, both of Conn.; Gregory Schienda, Tuscon, Ariz.

[73] Assignee: Otis Elevator Company, Farmington, Conn.

[21] Appl. No.: 546,225

[22] Filed: Oct. 27, 1983

[51] Int. Cl.[3] ..... B66B 3/00

[52] U.S. Cl. ..... 187/29 R

[58] Field of Search ..... 187/29

[56] References Cited

U.S. PATENT DOCUMENTS 3,782,504 1/1974 Billmaier et al. ..... 187/29

3,841,443 10/1974 Booker, Jr. ..... 187/29

3,851,735 12/1974 Winkler et al. ..... 187/29

3,903,499 9/1975 Oliver ..... 187/29 X

*Primary Examiner*—William M. Shoop

*Assistant Examiner*—W. E. Duncanson, Jr.

*Attorney, Agent, or Firm*—Gerald E. Linden

[57] ABSTRACT

An elevator control system wherein signals between fixtures and the controller are provided in time-division, half-duplex multiplexing protocol is disclosed. Remote stations (64, 150) serialize multiple fixture inputs (66–69) and outputs (106–109) and are characterized for response during particular time slots by binary address means (84). A master station (90) serializes multiple controller inputs (102–105) and outputs (93–96) and is responsive for all time slots in either a transmit or receive mode. A portion (82) of the controller (78) provides clocking (76) and dynamic addressing (98) for the system.

5 Claims, 7 Drawing Figures

MODULAR OPERATIONAL ELEVATOR CONTROL SYSTEM

Cross-reference is made to copending, commonly-owned U.S. application Ser. No. 546,219 filed on even date herewith by Kupersmith et al., and entitled INDUSTRIAL COMMUNICATIONS SYSTEM and to copending, commonly-owned U.S. application No. 442,391 filed on Nov. 17, 1982 by Tweed Jr., et al. and entitled ELEVATOR CONTROL.

TECHNICAL FIELD

This invention relates to elevator control and, more particularly, to communicating information such as passenger requests and status information between passengers and an elevator controller.

BACKGROUND ART

An elevator comprises a car that is movable in a hoistway to several landings. An elevator control system responds to passenger service requests and provides commands to motion and door subsystems to satisfy the requests while providing status information displays to the passengers indicative of the position and direction of travel of the car. The passenger service requests are provided in the control system via car/hall fixtures such as call buttons and key switches. Other fixtures, such as jewels, lanterns and displays provide the status information to the passengers. The fixtures are connected to a controller by cables, with at least one wire associated with each fixture and function. A traveling cable is connected between the car and the "stationary" equipment. It is desirable to reduce the number of conductors in the traveling cable to minimize weight. It is also desirable to reduce the number of connections that need to be made in the field to reduce installation expense and the possibility of miswiring. This is pertinent in the case of the traveling cable and for the cable connecting the stationary fixtures to the controller which is typically located in a machine room.

DISCLOSURE OF INVENTION

Therefore it is an object of this invention to provide for communication of passenger requests and status information between passengers and the elevator control system while requiring a minimum number of conductors and a minimum number of field connections, thereby reducing the possibility of miswiring and reducing wiring and installation costs, which are large for the more complex installations, especially those having many stops.

It is another object of this invention to provide for modularity wherein the basic hardware associated with each fixture is identical.

It is a further object of this invention to provide flexibility in configuring a wide variety of elevator control systems.

It is a still further object of this invention to provide an elevator control system suitable for both high-rise and low-rise applications and that is immune from RFI and other interference.

According to the invention, a time-division, half-duplex multiplex protocol is employed for communicating passenger request signals from fixtures to an elevator controller and for communicating status signals from the controller to the fixtures. Two levels of multiplexing are employed. At one level, each of several remote stations that are associated with the fixtures comes on-line for providing the passenger request signals to a data bus during an assigned time slot within a transceive cycle and comes on-line for providing the status signals from the data bus to its associated fixtures during an assigned other time slot. Each remote station is characterized, or addressed for response during the assigned (and assigned other) time slots by simple address means. At the next level, a number of I/O functions may be performed during discrete subdivisions (states) of each time slot and the signals associated with the I/O functions are provided in serial format on the data bus. A master station is associated with the controller and a portion of the controller is dedicated for providing clock pulses to synchronize the system. During a portion of the transceive cycle, in a system receive mode the master station demultiplexes the incoming passenger request signals from the data bus according to state and provides them on parallel lines to the dedicated portion of the controller, which in turn determines which remote station provided the signal according to the time slot in which it is received. The fully demultiplexed passenger request signal is then used in a traditional manner by the controller to control the elevator. During another portion of the transceive cycle, in a system transmit mode, status signals are provided on parallel inputs from the controller to the master station during the assigned other time slots. The parallel inputs correspond to the state at which the master station provides a signal to the data bus and the time slot is selected in the controller according to the particular remote station at which response is desired. At the receiving end, the remote station demultiplexes the status signal according to state during the assigned other time slot and provides the status signal to a particular fixture.

According further to the invention, some of the receive (remote to master) and transmit (master to remote) time slots are reserved for special functions and a state of all time slots is dedicated for parity checks or other functions.

The foregoing and other objects, features and advantages of the present invention will become more apparent in the light of the following detailed description of an exemplary embodiment thereof.

BEST MODE FOR CARRYING OUT THE INVENTION

Figure 1:
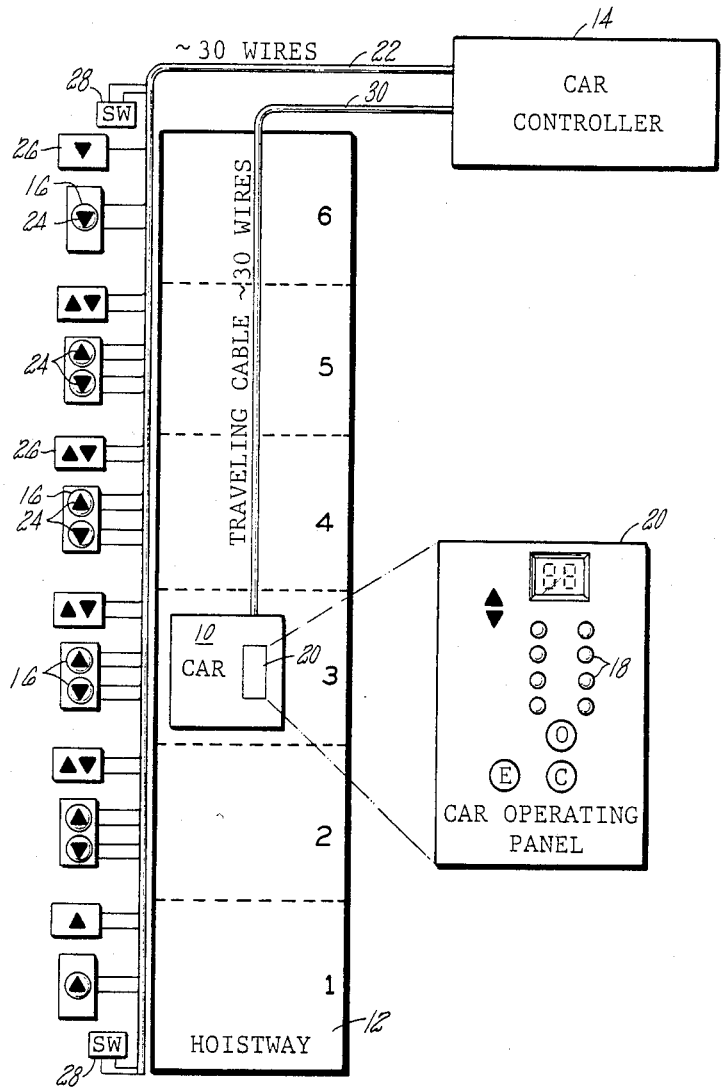
FIG. 1 PRIOR ART
FIG. 1 is a schematic block-diagram of an elevator of the prior art.

It is known in the prior art to provide at least one wire per function per fixture in an elevator control system. FIG. 1 shows an elevator control system of the prior art having a car 10 that is movable in a hoistway 12 to any of six numbered landings 1–6 in response to commands from a controller 14. Passenger service requests are provided on hall call buttons 16 located at each landing or on car call buttons 18 located on a car operating panel 20. With specific reference to hall calls, signals indicative of simple contact closures are provided to the controller 14 on a cable 22. Therefore, each hall call button 16 must be connected to the car controller 14 by a discrete conductor, or conductors, in the cable 22 in order for the controller 14 to recognize the origin (e.g., landing) of the hall call. The number of conductors in the cable 22 increases not only with the number of landings, but also with the different elevator functions. For instance, the controller 14 returns a signal over a conductor in the cable 22 to the hall call button 16 to light a lamp 24, indicating that the hall call has been registered by the controller 14. Furthermore, hall lanterns 26 indicate the arrival and direction of the car 10 in response to signals provided on separate conductors. Additional functions such as top and bottom switches 28, and keyswitch functions are also carried on the cable 22. In like manner, many conductors in a traveling cable 30 provide signals to and from the car operating panel 20. Thus, it is easily seen that the typical six-floor elevator of the prior art may require approximately thirty conductors in each of the cables 22, 30.

Figure 2:
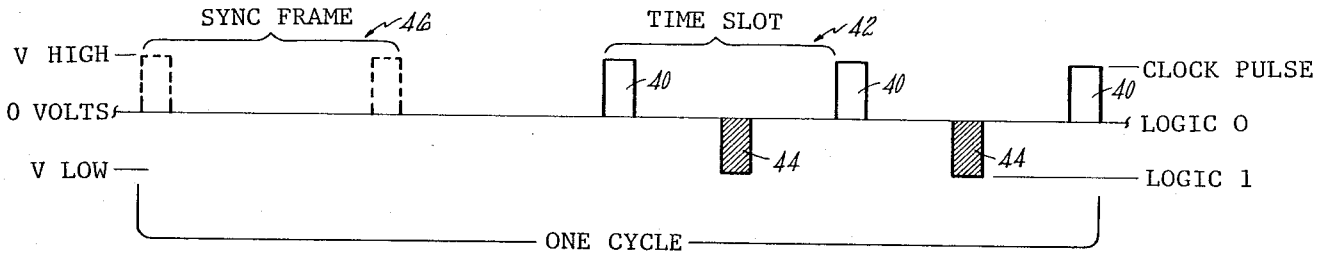
FIG. 2 is a simplified timing diagram of the protocol of the present invention.

The present invention embodies a communications system wherein the passenger request signals from many fixtures and functions associated therewith and the status signals from the elevator controller are provided in a time-division, half-duplex multiplex protocol over a transmission line. The general protocol for the system is illustrated in the simple timing diagram of FIG. 2. Therein, each cycle includes a finite number of clock pulses 40, which are positive voltage differentials in excess of a threshold on a transmission line. Each clock pulse marks the beginning of a time slot (information frame) 42 during which data bits 44 are transmitted and received. A logic ONE is provided as a negative voltage differential in excess of a threshold. A clock associated with a master station (not shown) provides the clock pulses 40 on the transmission line for synchronizing the system, and many remote stations may be multiplexed to a single 2-wire transmission line. A remote station becomes responsive (comes on-line) for sending or receiving signals during particular time slots by counting clock pulses from a sync frame 46 which is indicated by the absence of two clock pulses (shown in phantom). Remote stations may be assigned to come on-line in any order, but in the usual case they come on-line serially, i.e. one at a time in some ascertainable order.

Figure 3:
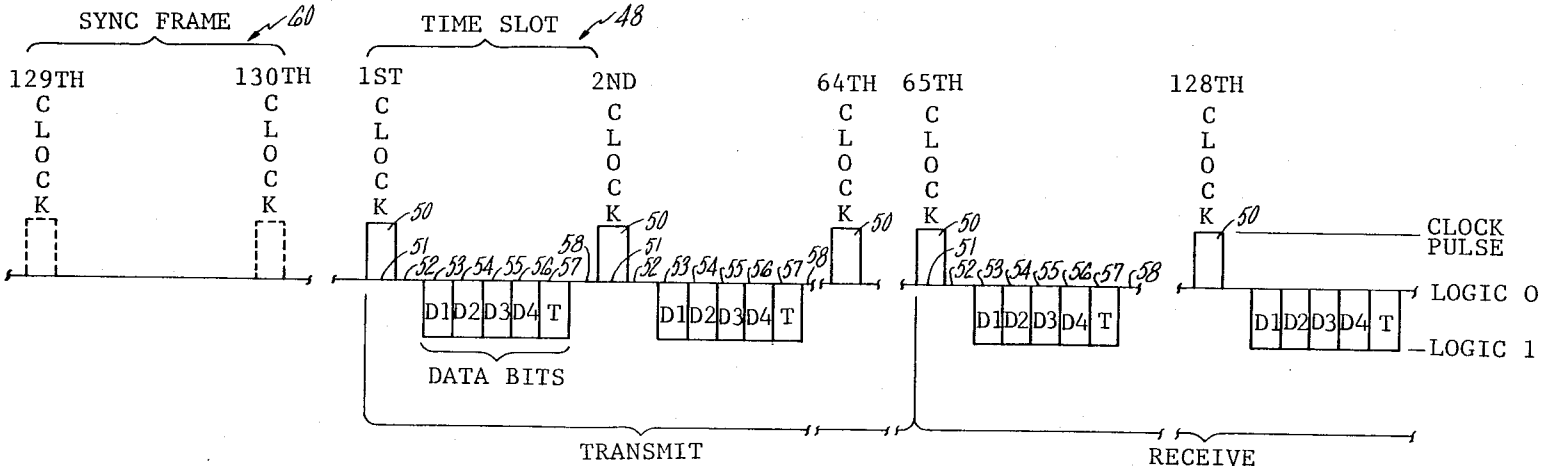
FIG. 3 is a detailed timing diagram of the protocol of the present invention.

Since an elevator control system is responsive to many inputs, such as various passenger requests originating from either a hall or the car, and also provides many outputs, such as indications of whether a call is registered or the direction, arrival, or position of the car, the protocol of the control system of this invention is configured to handle many discrete bits of data to or from each remote station. FIG. 3 shows the communications protocol wherein each time slot 48 is marked by a clock pulse 50 and is subdivided into eight states 51–58. A complete transceive cycle comprises 130 time slots (clock times), and the 129th and 130th clock pulses are omitted (shown in phantom) to provide a sync frame 60. For purposes of this description, the transceive cycle is 104 milliseconds, and each state is nominally one hundred microseconds, which is fast enough for elevator control, but is should be understood that a faster rate could be selected within the contraints imposed by transmission line and environmental characteristics. During the first state 51 of a time slot, the transmission line is driven by a clock associated with the master station to a positive voltage differential indicative of a clock pulse. During the second state 52, control of the line is relinquished. During the third state 53 a signal (data bit) D1, which is a negative voltage differential across the transmission line is transmitted. In like manner data bits D2–D4 are transmitted during the fourth 54, fifth 55 and sixth 56 states. The data bits D1–D4 are discrete, each indicative of a single function, but it should be understood that they may be formatted to form a four-bit binary word to provide a greater diversity of information per time slot. During the seventh state 57, a test bit T is transmitted. The test bit may be reserved as a spare data bit, may be used as a parity check, may be used to signal a special mode (e.g. fire service), or may be used to provide additional data (e.g. car position) over the span of many time slots. During the eighth state 58, control over the line is relinquished prior to a succeeding clock pulse. Since a particular remote station responds during a particular time slot, the data does not need start/stop characters and/or an address prefix on every word (D1–D4, T), which would increase bit overhead. The random remote station accessibility of an address-prefix multiplex format is not necessary in the context of this elevator control system. Moreover since it is not necessary for one remote station to communicate with another, but only with the master station, adequate communication is maintained with the protocol of the present invention. The state architecture of the first time slot is typical for all time slots.

To further provide simplicity of control, the multiplex protocol is half-duplex, wherein the first through sixty-fourth time slots (numbered according to the corresponding clock pulse) are dedicated for communication from master station to remote station (system transmit mode), and the sixty-fifth through one hundred, twenty-eighth time slots are dedicated for communication from remote station to master station (system receive mode.) In the parlance of this disclosure, "assigned time slots" are those of the system receive mode and "assigned other time slots" are those of the system transmit mode, with the following proviso. Certain time slots, such as first four each of the system transmit and receive modes (i.e. the first through fourth and sixty-fifth through sixty-eighth time slots) may be reserved for diagnostic/maintenance testing, or the control of optional features which may be incorporated at the remote stations.

Figure 4:
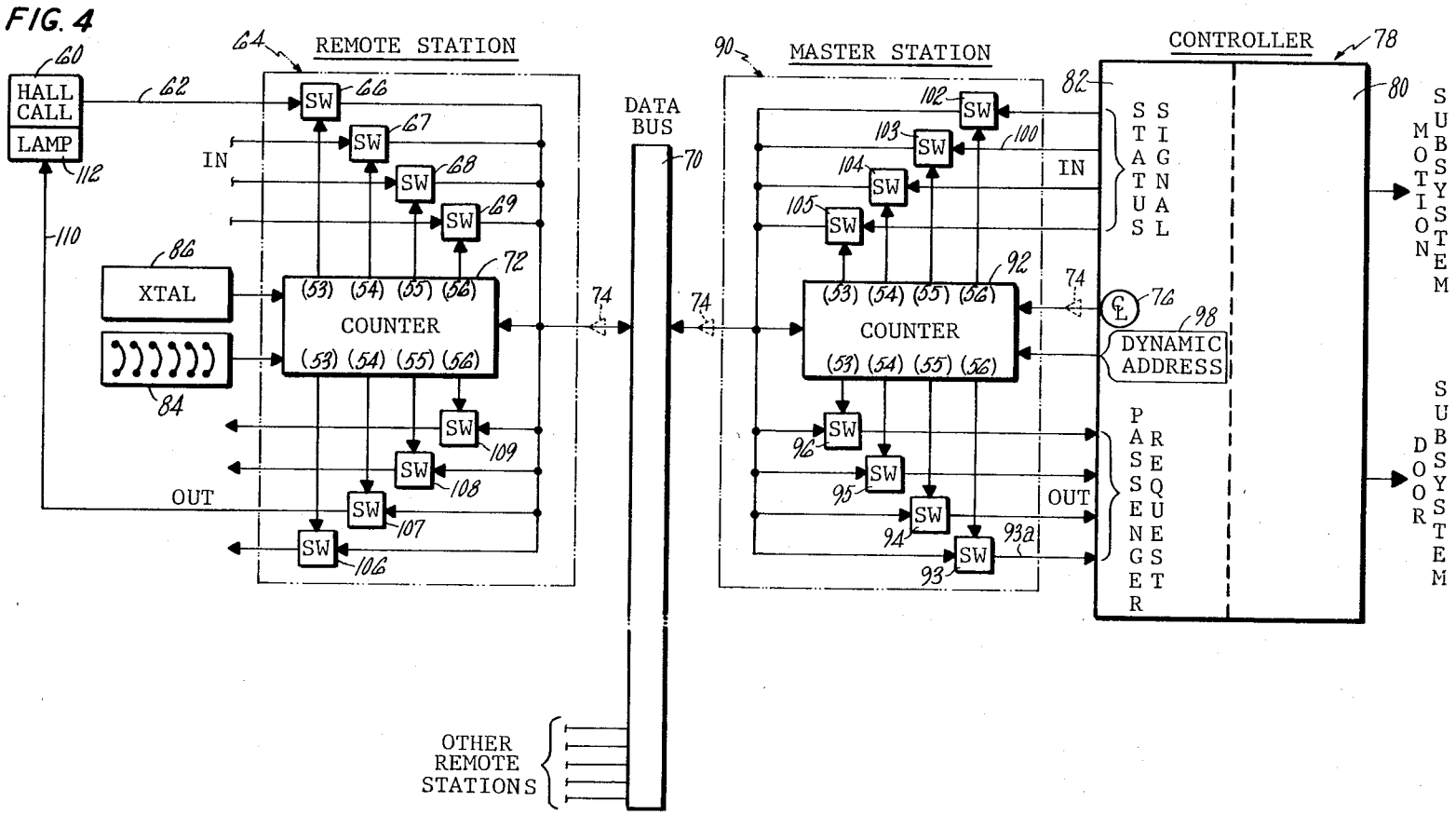
FIG. 4 is a simplified schematic block-diagram of the control system of the present invention.

With reference to FIG. 4 there is shown the control system hardware of this invention. For clarity, the operation of the system as it handles a hall call is particularly discussed, but it should be understood that the teachings disclosed herein are applicable to the communication of other signals. In the system receive mode passenger request signals are provided from fixtures to a controller. To call for a car, a passenger presses a hall call button 60. A passenger request signal is provided on a line 62 to a remote station 64 that is associated with the hall call button 60. Each remote station is configured to process four different passenger request signals as provided on four parallel input lines and provide the passenger request signals in a serial format to a transmission line (data bus) 70. Each parallel input line is associated with a different data state within an assigned time slot. The serialization of the passenger request signals is achieved by providing "receive" cue signals serially, according to the states (53–56) for data transmission (see FIG. 3), to four input switches 66–69, each of which is associated with a parallel input line, and each switch is connected to provide the passenger request signal from its associated input to the data bus 70 in response to the receive cue signals. The receive cue signals are provided by a counter 72 which is responsive to count clock pulses 74 that are provided on the data bus 70 by a master clock 76 which may be incorporated in a microprocessor-based controller 78, one portion 80 of which performs traditional elevator control functions, such as motion and door subsystems. The function of the remaining portion 82 of the controller, as it relates to this invention is discussed hereinafter. In this example, the hall call (passenger request signal) is provided to the data bus 70 by the input switch 66 during the third state (53) within an assigned time slot. The assigned time slot is marked by a clock pulse, as are all time slots, at a particular time after the sync frame wherein two clock pulses are not provided for two successive clock times. The counter 72 is able to determine the onset of the assigned time slot simply by counting clock pulses from an initial reset condition that corresponds to the sync frame, and comparing the count to an address that is determined by binary address means 84. When the count in the counter 72 is in agreement with a count established by the binary address means, the receive cue signals are provided to the bank of input switches 66–69. As will be seen, the remote station must also be responsive during an assigned other time slot in the transmit mode (master to remote). Rather than needing to establish a second count in the binary address means 84 with which the counter must agree, transmit cue signals are provided to a bank of output switches during the assigned other time slot—and the assigned other time slot (system transmit mode) bears a fixed relationship to the assigned time slot (system receive mode), such as: The count for the assigned time slot equals the count for the assigned other time slot plus sixty-four (half of the number of information frames in the transceive cycle). This is possible when the time slots are homogeneously grouped for transmit and receive (see FIG. 3). Therefore, by providing for only sixty-four addresses in the binary address means, which may be a five-pole dip-switch or five jumpers, the counter 72 may be a six bit counter with a carry-out to indicate which half of the transceive cycle is being counted. A counter reset signal is provided in the counter 72 in response to a comparison between clock pulses, which are internally generated in the counter, in sync with the clock pulses on the transmission line, under the control of a crystal 86, with the clock pulses provided on the data bus 70 by the clock 76. Thus, while not shown separately, the counter 72 performs a comparator function and a clock function. When two successive clock pulses are not provided by the clock, a reset signal is provided in the counter 72. For simplicity of installation, all five jumpers are installed during manufacture so that removal-by-cutting is all that is necessary to characterize a remote station for response during a particular time slot(s). An advantage of this approach is that the remote station controllers are fungible.

A master station 90 is similar to the remote station 64 and is shown herein as a mirror image thereof. In practice, the master station shares a common circuit with the remote stations as is described in greater detail in commonly-owned copending U.S. application Ser. No. 546,219 filed on even date herewith by Kupersmith et al., and entitled INDUSTRIAL COMMUNICATIONS SYSTEM, and which is herewith incorporated by reference. A counter 92 is operable to provide serial receive cue signals to output switches 93–96 during the four data states (53–56) of a receive (assigned) time slot. This demultiplexes the passenger request signals according to their state from serial format on the transmission line 70 and provides them on parallel output lines to the controller 78 for a determination of which time slot they are received in, which is indicative of the remote station from which the passenger request signals originated. In other words, the master station 90 demultiplexes according to state for each receive time slot, but an executive control or serial line interface routine in the portion 82 of the controller 78 is required to sort out the information of one time slot from another. Therefore, the hall call signal of this example is provided during the third state (53) of the assigned time slot and the master station counter 92 correspondingly provides a receive cue signal to the switch 93 during the third state (53) to provide the hall call signal to the controller 78 on a specific line 93*a*. The controller 78 is able to discern which remote station provided the signal, according to the time slot in which it is received-and also is able to distinguish which remote station input is associated with the signal according to the output line from the master station 90 on which it is received. This information is then used in the portion 80 of the controller 78 for control over the elevator.

Whereas remote stations are characterized for response during assigned and assigned other time slots by fixed binary address means, the master station 90 is addressed dynamically by a binary counter 98 in the controller portion 82. The binary counter 98 counts the clock pulses from the sync frame and outputs the addresses one through sixty-four for both the receive and transmit modes. Thereby the count in the master station counter 92 always agrees with the dynamic address (except during the sync frame) and the master station 90 is responsive during all of the assigned and assigned other time slots. During the assigned other time slots, a carry-out in the master station counter 92 signals the receive mode. Thus, modularity is achieved in that a common circuit can function as master as well as remote, with the peripherals (crystal and address means) being large determinative of the station's function. In other words, the clock input and dynamic address function characterize a station as a master station.

When a hall call is received by the controller, one response is to send an acknowledgement (status signal) to illuminate the call button, thereby indicating to the passenger that the call has been registered. The various functions of the controller insofar as responding to passenger request signals and providing status signals are described in detail in commonly-owned U.S. Pat. Nos. 4,363,381 (Bittar, 1982) entitled RELATIVE SYSTEM RESPONSE ELEVATOR CALL ASSIGNMENTS; 4,323,142 (Bittar, 1982) entitled DYNAMICALLY REEVALUATED ELEVATOR CALL ASSIGNMENTS; and 4,305,479 (Bittar et al., 1981) entitled VARIABLE ELEVATOR UP PEAK DISPATCHING INTERVAL. The controller 78 provides status signals during the assigned other time slots in the system transmit mode, the status signals being assigned to a particular time slot according to the remote station for which response is intended. Furthermore, a status signal is provided on a particular parallel input line to the master station 90 according to its particular function or intended output at the remote station. In this example, a hall call "acknowledgement" signal is provided on a line 100 to a switch 103 during the assigned other time slot for which the remote station 64 is responsive to status signals. Since the assigned other time slot is in the transmit mode of the transceive cycle, the absence of a carry-over in the counter 92 causes "transmit" cue signals to be provided serially, according to state (53–56) to a bank of output switches 102–105 and, more particularly, to the switch 103 to provide the acknowledgement signal from the parallel input line 100 to the data bus 70 during the fourth state (54).

Meanwhile, the remote station counter 72 recognizes the address of the assigned other time slot by comparison to the binary address means 84 and, since there is no carry-over, provides transmit cue signals to its bank output switches 106–109; more particularly to the switch 107 during the fourth state (54) to route the acknowledgement signal from the transmission line 70 to the appropriate remote station parallel output line 110 to illuminate a lamp 112 in the hall call button 60, thereby providing a display to the passenger that the call has been registered in the controller. As shown, many remote stations may be connected to the transmission line 70 and are individually characterized for response during particular assigned and assigned other time slots in the manner discussed hereinbefore.

The transmission line 70 is an unshielded twisted pair. The gauge of the wire is not critical but is expected to be no larger than 1.02 mm (18 AWG) and no smaller than 0.511 mm (24 AWG). An outer jacket for covering the pair is not a requirement, nor is it even desirable from an installation standpoint, since stripping back the jacket would be an extra labor step in connecting the cable to each remote station. To provide the greatest noise immunity, the unshielded transmission line has a characteristic impedance of approximately 100 ohms and will exhibit no more than 60 picofarads of capacitance per meter. Such a transmission line is suitable for elevator control applications involving cable runs of up to approximately 300 meters. Electrical power distribution lines (not shown) are also included in the transmission line.

Figure 5:
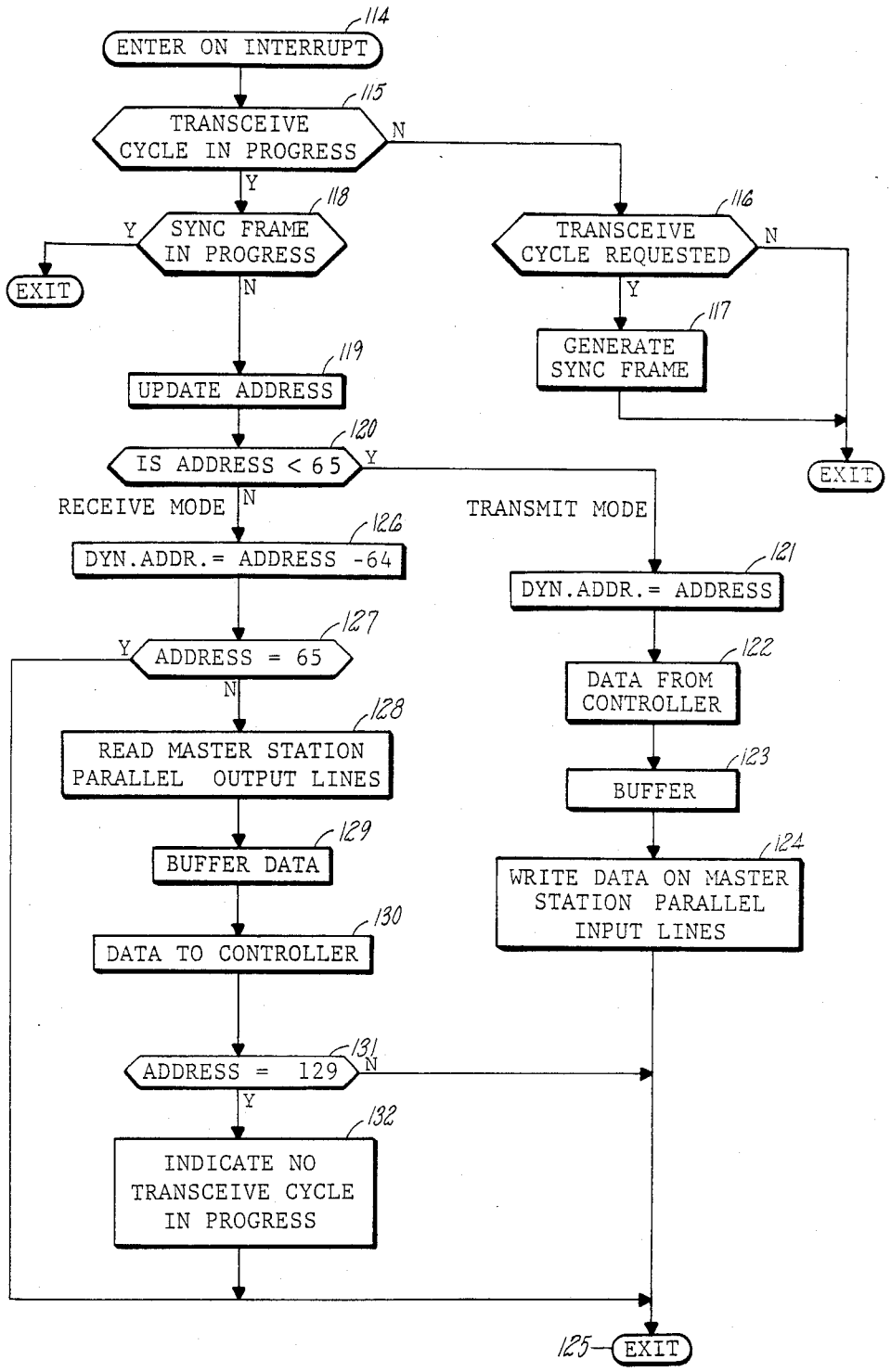
FIG. 5 is a flow chart of the serial line interface logic for this invention.

With reference to FIG. 5, the software associated with the serial line interface function of the controller portion 82 (FIG. 4) is shown as a subroutine that is entered at an entry port 114 each 800 microseconds, on an interrupt, which corresponds to the eight 100-microsecond states of a time slot in the transceive cycle. In a test 115 it is next determined whether the transceive cycle is in progress. In other words, the controller could be doing something else and not calling for the transceive cycle. If the transceive cycle is not in progress, the routine branches to a test 116 wherein, if the transceive cycle is not requested, the routine exits and, if the transceive cycle is requested by the controller, a new transceive cycle is initiated by the generation of a sync frame at a step 117. When the transceive cycle is in progress, it is first determined in a test 118 whether the sync frame is in progress, wherein no passenger request signals are read by the controller and no status signals are written by the controller and if the sync frame is in progress, the subroutine is bypassed. At the completion of the sync frame however, an address counter, which is initialized during the sync frame, is updated (incremented by ONE) at a step 119.

As mentioned hereinbefore, the first sixty-four time slots define the system transmit mode during which the controller provides status signals via the master station to the remote stations. Therefore, when it is determined in a test 120 that the transceive cycle is within the first sixty-four time slots, as indicated by the positive result of the test 120, the dynamic address is set to correspond with the address in a step 121 so that the master station is responsive, as discussed hereinbefore with respect to FIG. 4. Therefore, at a step 122, raw data corresponding to status signals is taken from the controller according to the remote station assigned to the current address and is buffered at a step 123 and then sorted according to the parallel input line of the master station to which it is provided, on parallel input lines, at a step 124, therein to be transmitted on the transmission line by the master station according to state. The routine then exits at a step 125 until another interrupt.

When address reaches sixty-five (the negative result of the test 120), the receive mode is initiated. As mentioned hereinbefore, the second sixty-four time slots define the system receive mode during which remote stations come on-line in queue to provide the passenger request signals in serial format on the transmission line. In an initial step 126 in the receive mode the dynamic address is set to the address less sixty four, since the master station is operable to distinguish the second half of the transceive cycle from the first as discussed hereinbefore. Next, at a step 127 it is determined whether this is the first receive time slot, In other words, if the address is sixty five, the routine exits through the step 125 to allow for the transition between the transmit mode and the receive mode, for the following reasons. Whereas in the transmit mode status signals are presented to the master station on the address associated with the remote station that is to receive the information, in the receive mode the passenger request signals are read on the clock pulse after the clock pulse associated with the address of the remote station that is providing the passenger request signals. This subtlety was not discussed with regard to the hardware description of FIG. 4 but it is an important practical consideration that is accounted for in this routine. Thus, the parallel output lines from the master station are read at a step 128 to provide four bits of information corresponding to the dynamic address minus one (five bits if the test bit is considered). This raw data, both the state and address (time slot) of which are known is buffered at a step 129 and then provided to the controller at a step 130 for response. It should be understood that the controller, as referenced herein, means that portion 82 of the controller 78 (FIG. 4) which performs the traditional functions of elevator control.

Having read the master station, the address is checked in a test 131 to see whether the receive mode is completed. The offset introduced at the step 127 accounts for the comparison herein being against one hundred twenty nine rather than against one hundred twenty eight. There are still one hundred twenty eight time slots for data, but one count is skipped between the transmit mode and the receive mode to synchronize the system. If the receive mode is not completed (address not one hundred twenty nine) the routine exits at the step 125 for another interrupt. If the receive mode is completed (address equals one hundred twenty nine), a flag is set at a step 132 to indicate that no transceive cycle is in progress and the routine exits.

The flowchart shown herein presents straight-forward functions in accordance with the previous hardware description and is capable of implementation in a variety of ways not specifically shown.

Figure 6:
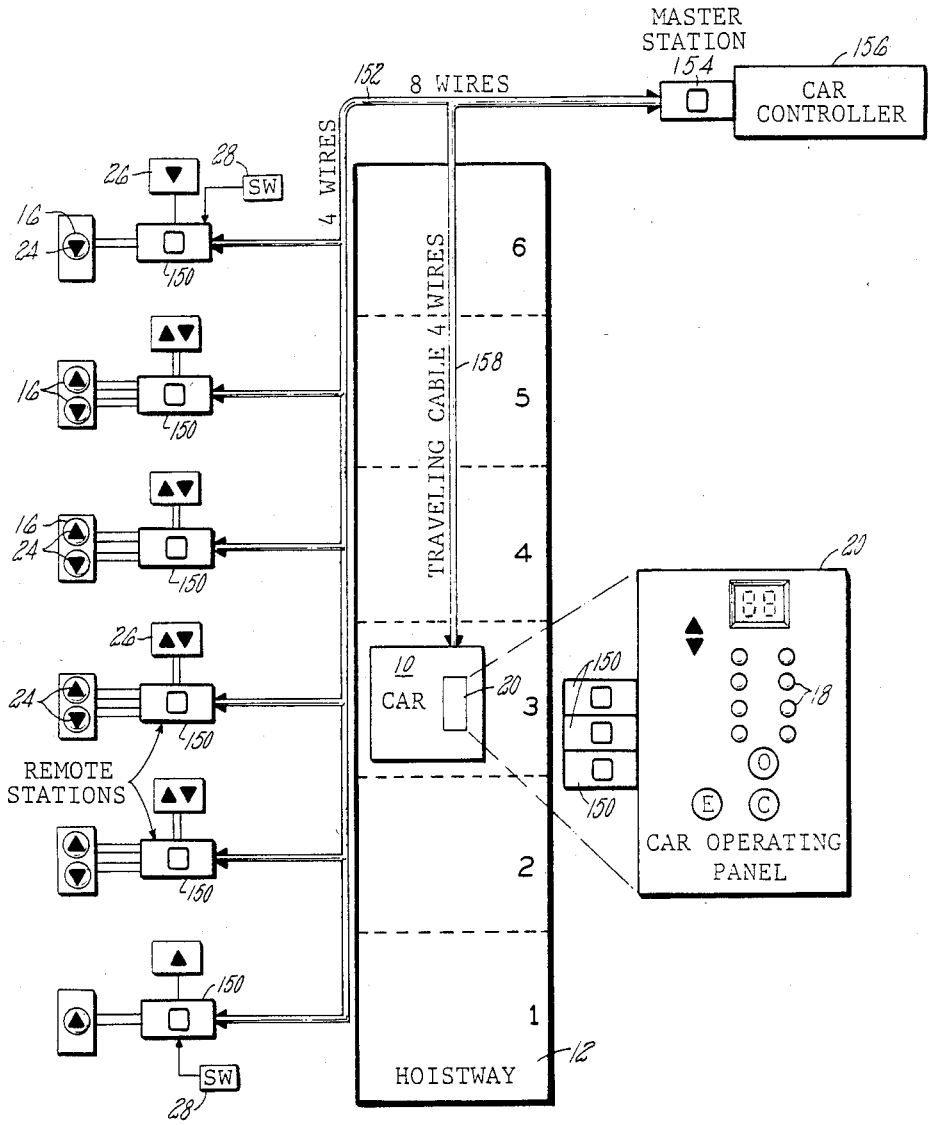
FIG. 6 is a schematic block-diagram of the control system of this invention in a single car configuration.

By using the control system of this invention, the number of separate conductors and connections required between car/hall fixtures and a car controller is greatly reduced. As shown in FIG. 6 remote stations 150 are associated with hall fixtures, such as a hall call button 16 and associated lamp 24, an up/down lantern 26, and top/bottom switches 28 and are connected via a four wire cable 152 (two line data bus plus two power lines) to a master station 154 which interfaces with a car controller 156. The clock and time slot routing functions are embodied in the controller 156, as discussed with reference to FIG. 4. Similarly, a four wire traveling cable 158 connects the car operating panel 20 to the car controller 14 via the master station 154. The traveling cable 158 and the cable 152 are simply connected in parallel at the master station 154 with a termination network (not shown) at the master station 154 and termination networks (not shown) at the farthest points along the cables 152, 158 from the master station 154. Each remote station 150 is associated with four input and four output functions at the car operating panel 20.

Figure 7:
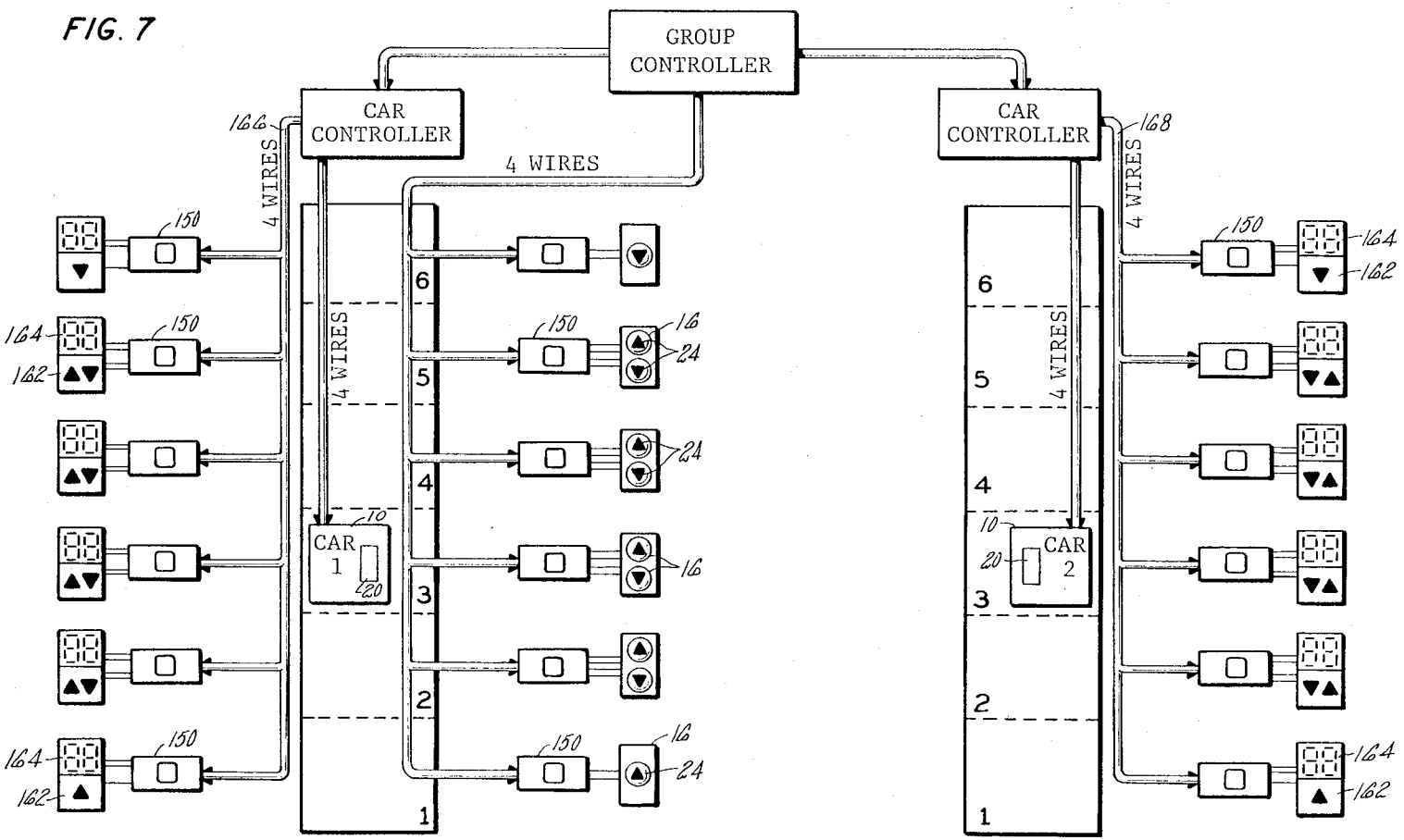
FIG. 7 is a schematic block-diagram of the control system of this invention in a group configuration.

As shown in FIG. 7, for multiple car arrangements the remote stations are arranged such that the common hall functions, notably the hall buttons 16 and associated jewels 24, would be connected to a line 160 of remote stations 150 and the hall-related car functions such as lanterns 162 and position indicators 164 would be connected to a separate line 166, 168 of remote stations on a per-car basis. It is readily apparent that the number of wires and connections is thereby greatly reduced, and the implementation of this particular embodiment is straightforward in light of the teachings contained herein and other well-known group control techniques. Split groups are also readily provided with the control system of this invention.

It should be understood that the number of time slots per transceive cycle can be varied and, although symmetry and simplicity are achieved by having an equal number of transmit and receive time slots, that relationship could also be varied, and that a sync frame could be indicated in other ways. It should also be understood that redundancy could be provided to enhance veracity in a number of ways, such as requiring a signal to persist for two or more cycles before responding to it. It should also be understood that many steps and functions, for instance the latching of transient signals, have been perfunctorily described and, in some cases, implied—those functions being of the nature that they will immediately be understood by those skilled in the art who examine the teachings of this invention. Therefore, the foregoing description is principally in terms of function-achieving blocks, and it should be understood that numerous variations may be utilized for achieving the same or equivalent functions and combinations of functions within the skill of the art. For instance, the discrete switches may actually be logic steps in microprocessor based software. It should be understood that the controller referred to herein is a microprocessor-based controller with the capability for the addition of the time slot management function in association with the master station, as described. Said function could, of course, be provided separately, with additional hardware. Although the invention has been shown and described with respect to an exemplary embodiment thereof, it should be understood that the foregoing and other changes, omissions and additions may be made therein and thereto, without departing from the spirit and scope of the invention.

What is claimed is:

1. A control system for controlling communication between passengers and an elevator controller including fixtures for providing passenger request signals in response to passenger service requests and for providing displays to the passengers indicative of status signals from the controller, and means for communicating the passenger request signals from the fixtures to the controller and for communicating the status signals from the controller to the fixtures, comprising:

a transmission line;

a portion of the controller dedicated to the control system for controlling communication between the passengers and the remainder of the controller for providing clock pulses on the transmission line to mark time slots in a transceive cycle of a time-division, half-duplex multiplex protocol; and a master station, connected between the portion of the controller and the transmission line, comprising:

first counter means for providing first receive cue signals during assigned time slots in response to the clock pulses and for providing first transmit cue signals during assigned other time slots in response to the clock pulses;

first output switch means for providing the passenger request signals from the transmission line in serial format to the portion of the controller on first parallel output lines in a system receive mode in response to the first receive signals according to the multiplex protocol; and first input switch means for providing the status signals from the portion of the controller on first parallel input lines to the transmission line in serial format in a system transmit mode in response to the first transmit signals according to the multiplex protocol;

remote stations, each connected between the fixtures and the transmission line and comprising:

second counter means for providing second receive cue signals during an assigned time slot in respose to the clock pulses and for providing second transmit cue signals during an assigned other time slot in response to the clock pulses;

second input switch means for providing the passenger request signals from the fixtures on second parallel input lines to the transmission line in serial format in the system receive mode in response to the second receive cue signals according to the multiplex protocol; and second output switch means for providing the status signals from the transmission line in serial format to the fixtures on second parallel output lines in the system transmit mode in response to the second transmit cue signals according to the multiplex protocol.

2. A control system according to claim 1, comprising:

a plurality of fixed binary address means, each for establishing a count and associated with a remote station wherein the second counter means of each remote station is operable to count the clock pulses from an initial reset condition and wherein the second transmit cue signals are provided in response to the fixed binary address means when said second counter means achieves a count in agreement with the count established by the fixed binary address means and the second receive cue signals are provided in response to the fixed binary address means when the second counter means achieves another count that corresponds to the count established by the fixed binary address means; and dynamic binary address means for establishing counts in response to said clock pulses wherein the second counter means of the master station is operable to count the clock pulses from an initial reset condition and wherein the second transmit cue signals and the second receive cue signals are provided in response to the dynamic binary address means when the second counter means achieves counts in agreement with the counts established by the dynamic address means.

3. A control system according to claim 1, wherein the fixed binary address means is jumpers and the count associated with each remote station is established by the configuration of the jumpers, thereby characterizing the remote station for response during an assigned time slot and an assigned other time slot.

4. A control system according to claim 1, wherein:

the portion of the controller does not provide clock pulses on the transmission line for at least one clock time to indicate a sync frame;

said master station comprises:

first clock means for providing internal clock pulses in the master station in sync with the clock pulses on the transmission line; and first comparator means for providing a first reset signal to the first counter means in response to the contemporaneous presence of an internal clock pulse in the master station and absence of said at least one clock pulse on the transmission line, indicative of the sync frame, thereby establishing the initial reset condition for the first counter means; and each remote station comprises:

second clock means for providing internal clock pulses in the remote stations in sync with the clock pulses on the transmission line; and second comparator means for providing a second reset signal to the second counter means in response to the contemporaneous presence of an internal clock pulse in the remote stations and absence of said at least one clock pulse on the transmission line, indicative of the sync frame, thereby establishing the initial reset condition for the second counter means.

5. A control system according to claim 4 comprising:

crystal means for controlling said second clock means; and wherein said first clock means is controlled by the clock pulses.

* * * * *